US009035852B2

(12) United States Patent
Koyama et al.

(10) Patent No.: US 9,035,852 B2
(45) Date of Patent: May 19, 2015

(54) METHOD FOR DRIVING LIGHT-EMITTING DEVICE

(75) Inventors: Jun Koyama, Sagamihara (JP); Hiroyuki Miyake, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 152 days.

(21) Appl. No.: 13/466,613

(22) Filed: May 8, 2012

(65) Prior Publication Data

US 2012/0287177 A1 Nov. 15, 2012

(30) Foreign Application Priority Data

May 13, 2011 (JP) ..... 2011-108029

(51) Int. Cl.
*G09G 3/30* (2006.01)
*G09G 3/32* (2006.01)

(52) U.S. Cl.
CPC ..... *G09G 3/3233* (2013.01); *G09G 2300/0861* (2013.01)

(58) Field of Classification Search
CPC ..... G09G 2300/0842; G09G 3/3225
USPC ..... 345/44–46, 76–81, 204–215
See application file for complete search history.

(56) References Cited

U.S. PATENT DOCUMENTS 6,768,348 B2 7/2004 Shionoiri et al.
7,091,750 B2 8/2006 Shionoiri et al.
7,456,810 B2 11/2008 Kimura
7,564,271 B2 7/2009 Shionoiri et al.
7,671,826 B2 3/2010 Kimura
7,679,585 B2 3/2010 Kimura
7,768,485 B2 8/2010 Uchino et al.
7,817,117 B2 10/2010 Kimura
7,847,598 B2 12/2010 Shionoiri et al.
7,924,244 B2 4/2011 Kimura et al.
7,982,696 B2 7/2011 Kimura
7,995,009 B2 8/2011 Umezaki
8,004,477 B2 8/2011 Uchino et al.
8,063,859 B2 11/2011 Kimura
8,149,018 B2 4/2012 Shionoiri et al.
8,164,547 B2 4/2012 Kimura
8,373,696 B2 * 2/2013 Miyazawa ..... 345/212
2007/0046590 A1 * 3/2007 Umezaki et al. ..... 345/76

(Continued)

FOREIGN PATENT DOCUMENTS

JP 2007-148129 6/2007
JP 2007-310311 11/2007

*Primary Examiner* — Alexander S Beck
*Assistant Examiner* — Charles Zheng
(74) *Attorney, Agent, or Firm* — Eric J. Robinson; Robinson Intellectual Property Law Office, P.C.

(57) ABSTRACT

A method for driving a light-emitting device comprises steps of: supplying a first potential to a drain of a transistor and a second potential being lower than the first potential to a cathode of a light-emitting element; supplying a third potential which is lower than a potential obtained by adding the threshold voltage of the transistor, the threshold voltage of the light-emitting element, and the second potential to a gate electrode of the transistor, and a fourth potential being lower than a potential obtained by subtracting the threshold voltage of the transistor from the third potential to the source of the transistor; stopping supply of the fourth potential to the source of the transistor; and supplying a potential of an image signal to the gate electrode of the transistor.

18 Claims, 4 Drawing Sheets

(56) References Cited

U.S. PATENT DOCUMENTS

| | | | | |
|---|---|---|---|---|
| 2007/0085847 | A1 | 4/2007 | Shishido | |
| 2007/0126664 | A1 | 6/2007 | Kimura | |
| 2007/0236424 | A1 * | 10/2007 | Kimura | 345/76 |
| 2008/0143653 | A1 | 6/2008 | Shishido | |
| 2008/0225061 | A1 | 9/2008 | Kimura et al. | |
| 2010/0149160 | A1 | 6/2010 | Kimura | |
| 2010/0156877 | A1 | 6/2010 | Kimura | |
| 2010/0220117 | A1 | 9/2010 | Kimura | |
| 2011/0115758 | A1 | 5/2011 | Kimura et al. | |
| 2011/0205215 | A1 | 8/2011 | Kimura | |
| 2011/0227067 | A1 | 9/2011 | Umezaki | |

* cited by examiner

FIG. 2A PERIOD T1
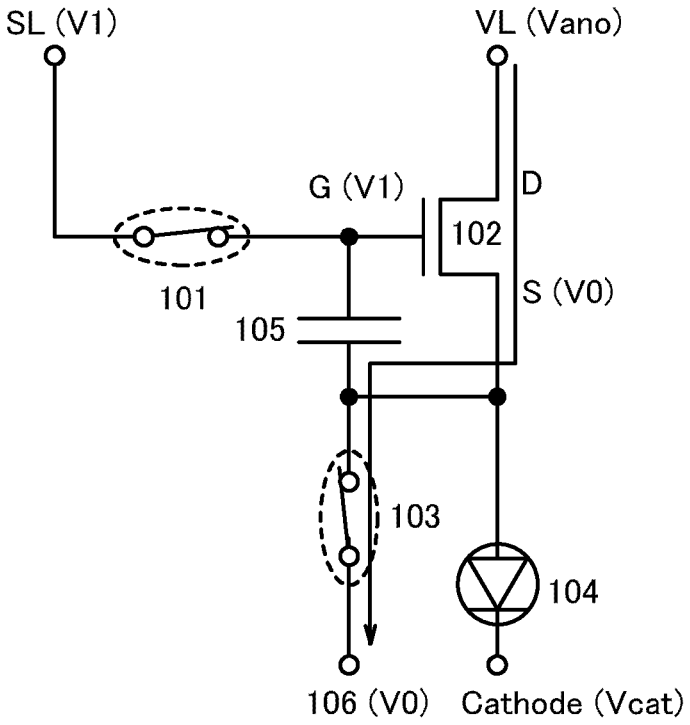
FIG. 2B PERIOD T2
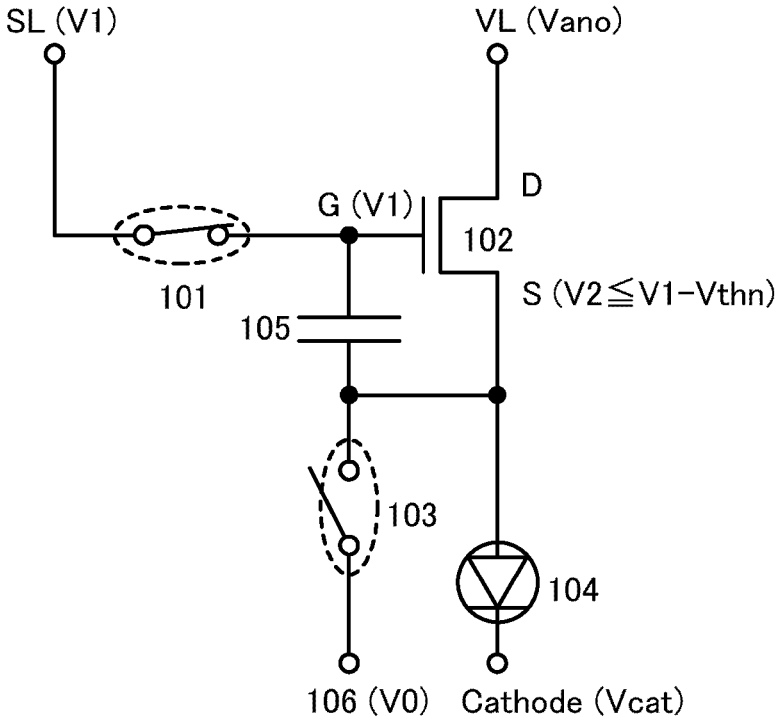

FIG. 3A PERIOD T3
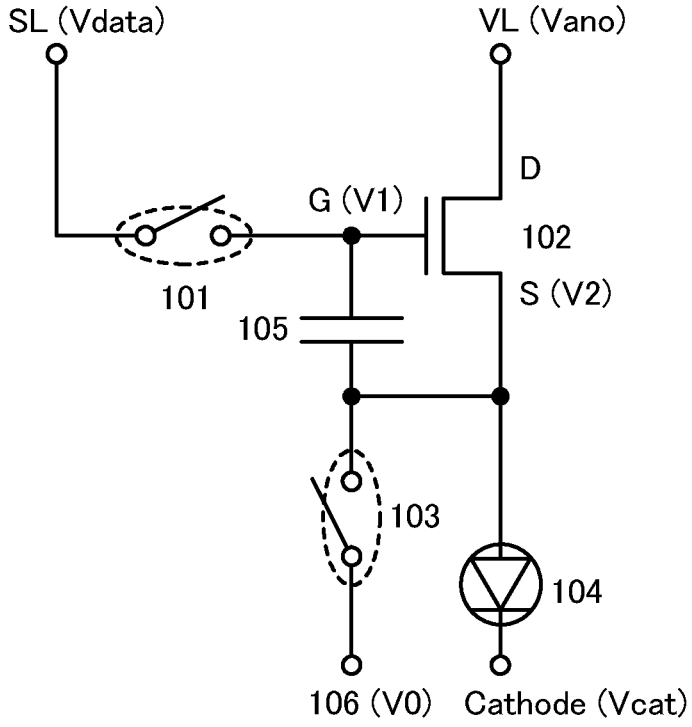
FIG. 3B PERIOD T4
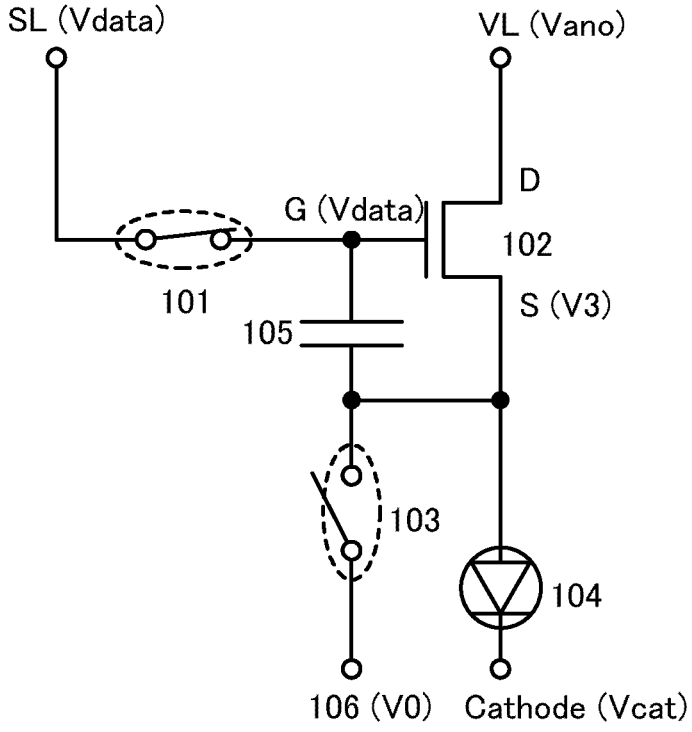

TERMINATION OF PERIOD T2

TERMINATION OF PERIOD T4

METHOD FOR DRIVING LIGHT-EMITTING DEVICE

BACKGROUND OF THE INVENTION

1. Field of the Invention

The present invention relates to a method for driving a light-emitting device in which a transistor is provided in each pixel.

2. Description of the Related Art

In an active matrix display device using a light-emitting element, in general, at least a light-emitting element, a transistor (a switching transistor) which controls input of a video signal to a pixel, and a transistor (a driving transistor) which controls a value of current supplied to the light-emitting element are provided in each pixel. In a light-emitting device having the above-described structure, drain current of the driving transistor is supplied to the light-emitting element; thus, when a variation in the threshold voltages of the driving transistors occurs among pixels, the luminances of light-emitting elements vary correspondingly.

Further, in the case where an n-channel transistor having higher mobility than a p-channel transistor is used as a driving transistor, a source of the driving transistor is connected to an anode of a light-emitting element. In that case, when the voltage between the anode and the cathode of the light-emitting element is increased owing to deterioration of an electroluminescent material, the potential of the source of the driving transistor is increased, whereby the voltage between a gate and the source (gate voltage) of the driving transistor is decreased. Accordingly, drain current of the driving transistor, that is, current supplied to the light-emitting element is decreased, resulting in a decrease in luminance of the light-emitting element.

In order to prevent the variation in luminance of the light-emitting elements due to the variation in the threshold voltages and the decrease in the luminance of the light-emitting elements due to deterioration of an electroluminescent layer, Patent Documents 1 and 2 each disclose a display device in which correction of the threshold voltage and correction of the potential of the anode are performed.

REFERENCE

Patent Document

[Patent Document 1] Japanese Published Patent Application No. 2007-310311

[Patent Document 2] Japanese Published Patent Application No. 2007-148129

In the display device disclosed in Patent Document 1, a potential of a power supply line connected to an anode through a driving transistor is controlled by a driver circuit called a power supply scanner. However, a large amount of current, such as the current supplied to the light-emitting element, flows to the power supply line. Therefore, high performance of supplying a large amount of current is required for the driver circuit which controls a potential of the power supply line, and thus a load on the driver circuit is large.

It is generally known that when all the transistors in the pixels have the same polarity, it is possible to omit some of steps for manufacturing the transistors, e.g., a step of adding an impurity element imparting one conductivity type to a semiconductor layer. However, in the display device disclosed in Patent Document 2, when a switching transistor for connecting a drive transistor to a power supply line is an n-channel transistor, a signal having a sufficiently larger voltage amplitude than a voltage between an anode and a cathode of a light-emitting element needs to be supplied to a gate electrode of the switching transistor. Accordingly, since high performance of supplying a large amount of current is also required for a driver circuit which supplies the above-described signal to the switching transistor, a load on the driver circuit is large.

SUMMARY OF THE INVENTION

In view of the foregoing technical background, an object of one embodiment of the present invention is to provide a method for driving a light-emitting device in which a load on a driver circuit is suppressed, and correction of a threshold voltage and correction of a potential of an anode are performed.

One embodiment of the present invention is a method for driving a light-emitting device including the steps of supplying a first potential to a drain of a transistor and a second potential which is lower than the first potential to a cathode of a light-emitting element, in which a source of the transistor and an anode of the light-emitting element are connected to each other, and in which a voltage between a gate electrode of the transistor and the source of the transistor is held in a capacitor; supplying, in a first period, a third potential which is lower than a potential obtained by adding the threshold voltage of the transistor, the threshold voltage of the light-emitting element, and the second potential to the gate electrode of the transistor, and a fourth potential which is lower than a potential obtained by subtracting the threshold voltage of the transistor from the third potential to the source of the transistor; stopping supply of the fourth potential to the source of the transistor in a second period; stopping supply of the third potential to the gate electrode of the transistor in a third period; and supplying a potential of an image signal to the gate electrode of the transistor in a fourth period.

One embodiment of the present invention is a method for driving a light-emitting device including the steps of supplying a first potential to a drain of a transistor and a second potential which is lower than the first potential to a cathode of a light-emitting element, in which a source of the transistor and an anode of the light-emitting element are connected to each other, and in which a voltage between a gate electrode of the transistor and the source of the transistor is held in a capacitor; supplying, in a first period, a third potential which is lower than a potential obtained by adding the threshold voltage of the transistor, the threshold voltage of the light-emitting element, and the second potential to the gate electrode of the transistor, and a fourth potential which is lower than a potential obtained by subtracting the threshold voltage of the transistor from the third potential to the source of the transistor; stopping supply of the fourth potential to the source of the transistor in a second period; and supplying a potential of an image signal to the gate electrode of the transistor in a third period.

Note that a capacitance value of the capacitor is smaller than that of the light-emitting element.

According to the above-described method for driving a light-emitting device, a potential obtained by adding a voltage of the image signal and the threshold voltage of the transistor can be supplied to the gate electrode of the transistor. Thus, by the driving method according to one embodiment of the present invention, a load on a driver circuit can be suppressed, and correction of the threshold voltage and correction of a potential of the anode can be performed.

BRIEF DESCRIPTION OF THE DRAWINGS

In the accompanying drawings:

FIGS. 2A and 2B illustrate a method for driving a pixel;

FIGS. 3A and 3B illustrate a method for driving the pixel; and

DETAILED DESCRIPTION OF THE INVENTION

Hereinafter, an embodiment of the present invention will be described in detail with reference to the accompanying drawings. However, the present invention is not limited to the following description and it is easily understood by those skilled in the art that the mode and details can be variously changed without departing from the scope and spirit of the present invention. Accordingly, the invention should not be construed as being limited to the description of the embodiment below.

Note that in this specification, a light-emitting device includes, in its category, a panel in which a light-emitting element is formed in each pixel and a module in which an IC or the like including a controller is mounted on the panel.

Figure 1A:
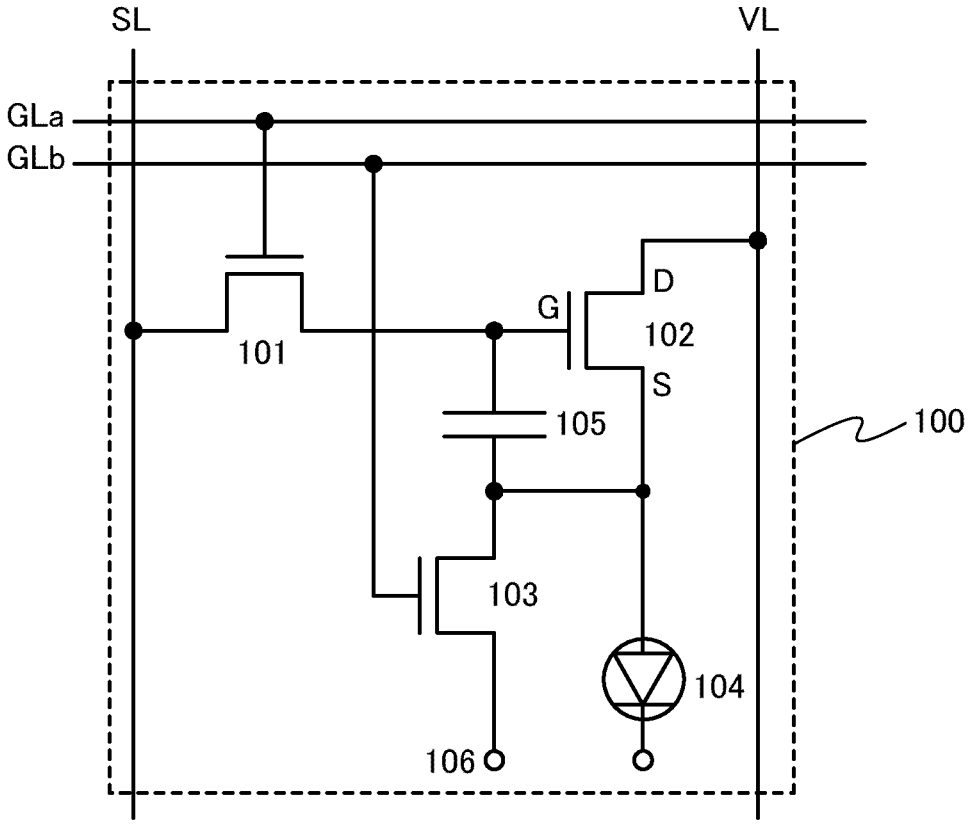
FIG. 1A is a circuit diagram of a pixel.

First, a structure of a pixel in which a driving method according to one embodiment of the present invention is used will be described. FIG. 1A illustrates an example of a circuit diagram of the pixel.

A pixel 100 illustrated in FIG. 1A includes a transistor 101, a transistor 102, a transistor 103, a light-emitting element 104, and a capacitor 105. The transistor 101 controls supply of a potential of an image signal to a gate electrode (denoted by G) of the transistor 102. The transistor 102 controls a value of a current supplied to the light-emitting element 104 in accordance with the potential of the image signal supplied to the gate electrode. The transistor 103 controls a potential of a source (denoted by S) of the transistor 102. The capacitor 105 holds the voltage between the gate electrode and the source of the transistor 102.

Hereinafter, a structure of the pixel 100 will be more specifically described. A gate electrode of the transistor 101 is connected to a first scan line GLa. One of a source and a drain of the transistor 101 is connected to a signal line SL, and the other of the source and the drain of the transistor 101 is connected to the gate electrode of the transistor 102. The source of the transistor 102 is connected to an anode of the light-emitting element 104, and a drain of the transistor 102 is connected to a power supply line VL. A gate electrode of the transistor 103 is connected to a second scan line GLb. One of a source and a drain of the transistor 103 is connected to the source of the transistor 102, and the other of the source and the drain of the transistor 103 is connected to a node 106 to which a potential V0 is supplied. A first electrode of the capacitor 105 is connected to the gate electrode of the transistor 102. A second electrode of the capacitor 105 is connected to the source of the transistor 102.

Note that in this specification, being "connected" means being "electrically connected" and corresponds to a state in which current, voltage, or a potential can be supplied or transmitted. Therefore, the state of being "connected" means not only a state of direct connection but also a state of indirect connection through an element such as a wiring, a conductive film, a resistor, a diode, or a transistor, where a current, a voltage, or a potential can be supplied or transmitted.

In addition, even when different components are connected to each other in a circuit diagram, there is actually a case where one conductive film has functions of a plurality of components such as a case where part of a wiring serves as an electrode. In this specification, being "connected" also means such a case where one conductive film has functions of a plurality of components.

The names of the "source" and the "drain" of the transistor interchange with each other depending on the polarity of the transistor or the levels of potentials applied to the respective electrodes. In general, in an n-channel transistor, an electrode to which a lower potential is applied is called a source, and an electrode to which a higher potential is applied is called a drain. In a p-channel transistor, an electrode to which a low potential is applied is called a drain, and an electrode to which a high potential is applied is called a source. In this specification, although connection relation of the transistor is described assuming that the source and the drain are fixed in some cases for convenience, actually, the names of the source and the drain interchange with each other depending on the relation of the potentials.

The light-emitting element 104 includes the anode, a cathode, and an EL layer provided between the anode and the cathode. The EL layer is formed using a single layer or plural layers which include at least a light-emitting layer containing a light-emitting substance. From the EL layer, electroluminescence is obtained by current supplied when a potential difference between the cathode and the anode, using the potential of the cathode as a reference potential, is higher than or equal to the threshold voltage Vthe of the light-emitting element 104. As electroluminescence, there are luminescence (fluorescence) at the time of returning from a singlet-excited state to a ground state and luminescence (phosphorescence) at the time of returning from a triplet-excited state to a ground state.

In the pixel 100 illustrated in FIG. 1A, the transistor 102 is an n-channel transistor. Each of the transistor 101 and the transistor 103 may be either an n-channel transistor or a p-channel transistor. Note that when the transistor 101, the transistor 102, and the transistor 103 are all n-channel transistors, a manufacturing process of a light-emitting device can be simplified.

Further, any of the transistor 101, the transistor 102, and the transistor 103 may include a wide-gap semiconductor such as an oxide semiconductor in the active layer, and may be formed using an amorphous, microcrystalline, polycrystalline, or single crystal semiconductor of silicon, germanium, or the like.

As the oxide semiconductor, for example, an indium oxide, a tin oxide, a zinc oxide, a two-component metal oxide such as an In—Zn-based oxide, a Sn—Zn-based oxide, an Al—Zn-based oxide, a Zn—Mg-based oxide, a Sn—Mg-based oxide, an In—Mg-based oxide, or an In—Ga-based oxide, a three-component metal oxide such as an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, or an In—Lu—Zn-based oxide, a four-component metal oxide such as an In—Sn—Ga—Zn-based oxide, an In—Hf—Ga—Zn-based oxide, an In—Al—Ga—

Zn-based oxide, an In—Sn—Al—Zn-based oxide, an In—Sn—Hf—Zn-based oxide, or an In—Hf—Al—Zn-based oxide can be used.

Note that, for example, an In—Ga—Zn-based oxide means an oxide containing In, Ga, and Zn, and there is no limitation on the composition ratio of In, Ga, and Zn. The In—Ga—Zn-based oxide may contain a metal element other than the In, Ga, and Zn.

Alternatively, a material represented by $InMO_3(ZnO)_m$ (m>0 is satisfied, and m is not an integer) may be used as an oxide semiconductor. Note that M represents one or more metal elements selected from Ga, Fe, Mn, and Co. Still alternatively, as the oxide semiconductor, a material represented by $In_2SnO_5(ZnO)_n$ (n>0 is satisfied, and n is a natural number) may be used.

For example, an In—Ga—Zn-based oxide with an atomic ratio of In:Ga:Zn=1:1:1 (=1/3:1/3:1/3) or In:Ga:Zn=2:2:1 (=2/5:2/5:1/5), or an oxide with an atomic ratio close to the above atomic ratios can be used. Alternatively, an In—Sn—Zn-based oxide with an atomic ratio of In:Sn:Zn=1:1:1 (=1/3:1/3:1/3), In:Sn:Zn=2:1:3 (=1/3:1/6:1/2), or In:Sn:Zn=2:1:5 (=1/4:1/8:5/8), or an oxide with an atomic ratio close to the above atomic ratios may be used.

Note that an oxide semiconductor preferably contains at least indium (In) or zinc (Zn). In particular, In and Zn are preferably contained. As a stabilizer for reducing variation in electric characteristics of a transistor using the oxide semiconductor, gallium (Ga) is preferably additionally contained. Tin (Sn) is preferably contained as a stabilizer. Hafnium (Hf) is preferably contained as a stabilizer. Aluminum (Al) is preferably contained as a stabilizer.

As another stabilizer, one or plural kinds of lanthanoid such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), or lutetium (Lu) may be contained.

Further, as a silicon semiconductor, any of the following can be used, for example: amorphous silicon manufactured by a vapor phase growth method such as a plasma CVD method, or a sputtering method; polycrystalline silicon obtained in such a manner that an amorphous silicon is crystallized by treatment such as laser annealing; single crystal silicon obtained in such a manner that a surface portion of a single crystal silicon wafer is separated by implantation of hydrogen ions or the like into the silicon wafer; and the like.

Further, although FIG. 1A illustrates a case where the capacitor 105 is provided in the pixel 100, the capacitor 105 is not necessarily provided in the case where a gate capacitance formed between the gate electrode and an active layer of the transistor 102 is large enough.

Figure 1B:
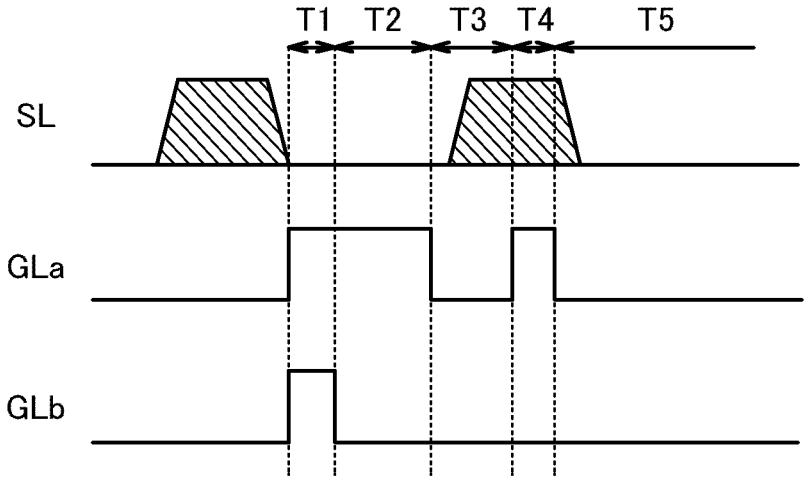
FIG. 1B is a timing chart.

Next, operation of the pixel 100 will be described. FIG. 1B illustrates an example of a timing chart of potentials supplied to the signal line SL, the first scan line GLa, and the second scan line GLb.

The operation of the pixel 100 can be described with five divided periods T1, T2, T3, T4, and T5 as shown in FIG. 1B. FIGS. 2A and 2B and FIGS. 3A and 3B schematically illustrate operations of the pixel during the respective periods. Note that in each of FIGS. 2A and 2B and FIGS. 3A and 3B, the transistor 101 and the transistor 103 serving as switching elements are illustrated as switches.

Through the periods T1, T2, T3, T4, and T5, a potential Vano (a first potential) is supplied to the power supply line VL, and a potential Vcat (a second potential) is supplied to the cathode of the light-emitting element 104. The potential difference between the potential Vano and the potential Vcat, using the potential Vcat as a reference potential, is higher than or equal to the threshold voltage Vthe of the light-emitting element 104.

First, as illustrated in FIG. 2A, in the period T1, the potentials of the first scan line GLa and the second scan line GLb are set to a high level, whereby the transistor 101 and the transistor 103 are turned on.

When the transistor 101 is on, a potential V1 (a third potential) is supplied to the signal line SL, whereby the potential V1 is supplied to the gate electrode (denoted by G) of the transistor 102 through the transistor 101. The potential V1 is lower than a potential obtained by adding the threshold voltage Vthn of the transistor 102, the threshold voltage Vthe of the light-emitting element 104, and Vcat. In other words, V1<Vcat+Vthe+Vthn is satisfied.

Further, the potential V0 (a fourth potential) of the node 106 is supplied to the source (denoted by S) of the transistor 102 through the transistor 103 which is on. The potential V0 is lower than a potential obtained by subtracting the threshold voltage Vthn of the transistor 102 from the potential V1. In other words, V0<V1−Vthn is satisfied.

By the above-described operation, the potential difference between the gate electrode and the source of the transistor 102, using the potential of the source as a reference potential, that is, a gate voltage Vgs, is higher than the threshold voltage Vthn, and thus the transistor 102 is turned on. The gate voltage Vgs is held by the capacitor 105. Accordingly, as indicated by an arrow, a current corresponding to the gate voltage Vgs flows between the power supply line VL and the node 106.

Further, the voltage between the anode and the cathode of the light-emitting element 104 is lower than the threshold voltage Vthe of the light-emitting element 104. Accordingly, in the period T1, the light-emitting element 104 does not emit light.

Next, as illustrated in FIG. 2B, in the period T2, the potential of the first scan line GLa is kept at a high level; therefore, the transistor 101 is kept on. The potential of the second scan line GLb changes from a high level to a low level, so that the transistor 103 is turned off.

By the above-described operation, a current path formed between the power supply line VL and the node 106 is interrupted, and thus the potential of the source of the transistor 102 starts to increase. Finally, the gate voltage Vgs of the transistor 102 is equal to the threshold voltage Vthn of the transistor 102, and thus the transistor 102 is turned off. The gate voltage Vgs which is the threshold voltage Vthn while the transistor 102 is off is held by the capacitor 105.

In one embodiment of the present invention, the period T2 is not necessarily terminated in a state where the gate voltage Vgs of the transistor 102 is equal to the threshold voltage Vthn. For example, when the potential of the source of the transistor 102 is a potential V2, the period T2 may be terminated in a state where the potential V2 is lower than a potential obtained by subtracting the threshold voltage Vthn of the transistor 102 from the potential V1. In other words, the potential V2 at the termination of the period T2 may be set as follows: V2≤V1−Vthn.

Note that the voltage between the anode and the cathode of the light-emitting element 104 is lower than the threshold voltage Vthe of the light-emitting element 104 even when the potential V2 at the termination of the period T2 is equal to V1−Vthn. Accordingly, in the period T2, the light-emitting element 104 does not emit light.

Next, as illustrated in FIG. 3A, in the period T3, the potential of the first scan line GLa changes from a high level to a low level, so that the transistor 101 is turned off. The potential of the second scan line GLb is kept at a low level; therefore, the transistor 103 is kept off. When the transistor 101 is off, a potential Vdata of an image signal is supplied to the signal line SL.

Note that in this embodiment, in the period T3, the potential Vdata is supplied to the signal line SL in advance while the transistor 101 is off; however, one embodiment of the present invention is not limited to this. The period T3 is not necessarily provided. Note that the potential Vdata is supplied to the signal line SL in advance, whereby when the transistor 101 is turned on in the next period T4, the potential of the gate electrode of the transistor 102 can be made closer to the potential Vdata of the image signal in a short time.

Next, as illustrated in FIG. 3B, in the period T4, the potential of the first scan line GLa changes from a low level to a high level, so that the transistor 101 is turned on. The potential of the second scan line GLb is kept at a low level; therefore, the transistor 103 is kept off. The potential Vdata of the image signal is supplied to the signal line SL.

By the above-described operation, the potential Vdata of the image signal is supplied to the gate electrode of the transistor 102 through the transistor 101 which is on. Needless to say, the level of the potential Vdata of the image signal is varied depending on image data included in the image signal.

A potential V3 of the source of the transistor 102 at the termination of the period T4 will be described below.

Figure 4A:
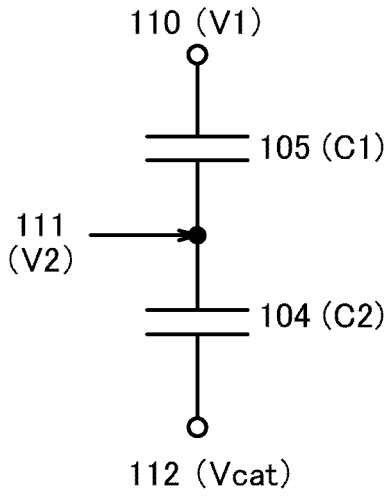
FIGS. 4A and 4B schematically illustrate a state where a capacitor and a light-emitting element are connected to each other in series.
Figure 4B:
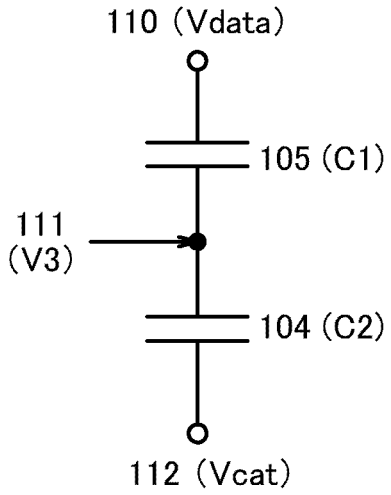

The pixel 100 illustrated in FIG. 1A has a structure in which the capacitor 105 and the light-emitting element 104 are connected to each other in series. FIGS. 4A and 4B schematically illustrate a state where the capacitor 105 and the light-emitting element 104 are connected to each other in series. In each of FIGS. 4A and 4B, the light-emitting element 104 is illustrated as one capacitor. FIG. 4A corresponds to the termination of the period T2, and FIG. 4B corresponds to the termination of the period T4.

As illustrated in FIG. 4A, at the termination of the period T2, the potential V1 is supplied to a first electrode 110 of the capacitor 105. A second electrode of the capacitor 105 and the anode (hereinafter, denoted by a node 111) of the light-emitting element 104 have the potential V2. The potential Vcat is supplied to a cathode 112 of the light-emitting element 104. At the termination of the period T4, the potential Vdata of the image signal is supplied to the first electrode 110 of the capacitor 105, and thus as illustrated in FIG. 4B, the potential V3 of the node 111 is determined by the ratio of a capacitance value C1 of the capacitor 105 to a capacitance value C2 of the light-emitting element 104 if the transistor 102 is off.

However, the transistor 102 is turned on in the period T4 depending on the level of the potential Vdata, so that electric charge flows into the node 111 through the transistor 102. Accordingly, the potential V3 of the node 111 in the period T4 is changed not only by the ratio of the capacitance value C1 of the capacitor 105 to the capacitance value C2 of the light-emitting element 104 but also by the amount of electric charge which flows into the node 111.

Specifically, when the potential of the node 111 at the termination of the period T4 is the potential V3, the gate voltage Vgs of the transistor 102 in the period T4 is represented by Formula 1. Note that Formula 1 holds for V2=V1−Vthn. Further, Q1 refers to the amount of electric charge which flows into the node 111.

$$Vgs=V\text{data}-V3=C2(V\text{data}-V1)/(C1+C2)+Vthn-Q1/(C1+C2) \quad \text{(Formula 1)}$$

Note that an ideal gate voltage Vgs at the termination of the period T4 is Vdata−V1+Vthn. When the gate voltage Vgs has this value, even when a variation in the threshold voltages Vthn of the transistors 102 occurs, the variation does not affect the drain current of the transistor 102. In order to make the gate voltage Vgs close to the ideal value, it is found from Formula 1 that C2/(C1+C2) is preferably made close to 1. In other words, it is preferable that the capacitance value C2 of the light-emitting element 104 be sufficiently larger than the capacitance value C1 of the capacitor 105 because the gate voltage Vgs can be made close to the ideal value.

Further, in order to make the gate voltage Vgs close to the ideal value, it is found from Formula 1 that Q1/(C1+C2) is preferably made small. In other words, it is preferable that the amount Q1 of electric charge which flows into the node 111 be made small in order to make the gate voltage Vgs close to the ideal value. Accordingly, the period T4 is preferably as short as possible in order to make the amount Q1 of electric charge small. Note that as described above, the potential Vdata is supplied to the signal line SL in advance in the period T3, whereby when the transistor 101 is turned on in the period T4, the potential of the gate electrode of the transistor 102 can be made closer to the potential Vdata of the image signal in a short time. Thus, the period T4 can be short, which is preferable in order to make the amount Q1 of electric charge small.

Needless to say, the level of the potential Vdata of the image signal is varied depending on image data included in the image signal. Note that the potential Vdata is preferably lower than a voltage obtained by adding the potential Vcat of the cathode and the threshold voltage Vthe of the light-emitting element 104. In other words, Vdata<Vcat+Vthe is preferable. The upper limit of the potential Vdata of the image signal is set to the above value, whereby the voltage between the first electrode 110 of the capacitor 105 and the cathode 112 of the light-emitting element 104 can be made lower than the threshold voltage of the light-emitting element 104. Accordingly, the voltage applied to the light-emitting element 104, that is, the voltage between the node 111 and the cathode 112 can be made lower than the threshold voltage Vthe, so that in the period T4, the light-emitting element 104 can be kept in a state where it does not emit light.

The gate voltage Vgs set in the period T4 is held by the capacitor 105.

Next, in the period T5, the potential of the first scan line GLa changes from a high level to a low level, so that the transistor 101 is turned off. The potential of the second scan line GLb is kept at a low level; therefore, the transistor 103 is kept off.

The gate voltage Vgs set in the period T4 is held by the capacitor 105. Since the transistor 101 is off, the gate electrode of the transistor 102 is in a floating state. Accordingly, in the case where the transistor 102 is on in accordance with the potential Vdata, current flows into the transistor 102, whereby the potential of the source of the transistor 101 is increased while the gate voltage Vgs is held. As a result, the voltage between the anode and the cathode of the light-emitting element 104 is higher than the threshold voltage Vthe of the light-emitting element 104, and thus the light-emitting element 104 emits light. On the other hand, in the case where the transistor 102 is off in accordance with the potential Vdata, current is not supplied to the light-emitting element 104, and thus the light-emitting element 104 does not emit light.

The above operation is performed per line of pixels 100. "Line of pixels 100" means a group of pixels whose gate electrodes of the transistors 101 are connected to each other. Writing of an image signal is performed per line of pixels 100, and image signals are written to all the pixels 100 in a pixel portion, whereby image display is performed.

According to one embodiment of the present invention, a potential obtained by adding the potential of the image signal and the threshold voltage of the transistor can be supplied to the gate electrode of the transistor 102 by the above-described driving method. Accordingly, by the driving method according to one embodiment of the present invention, correction of the threshold voltage and correction of the potential of the anode can be performed while a load on a driver circuit is suppressed.

Note that in a light-emitting device in which the threshold voltage of a transistor which controls a value of current supplied to the light-emitting element is obtained in such a manner that a gate electrode and a drain are electrically connected to each other, the potential of the source of the transistor is not higher than the potential of the gate electrode. Therefore, in the case where the transistor is a normally on transistor, it is difficult to obtain the threshold voltage.

However, in the light-emitting device according to one embodiment of the present invention, the drain of the transistor 102 and the gate electrode of the transistor 102 are electrically insulated from each other, so that the potentials of the drain and the gate electrode of the transistor 102 can be individually controlled. Accordingly, in the period T2, the potential of the drain of the transistor 102 can be set to be higher than the potential of the gate electrode of the transistor 102. Therefore, in the case where the transistor 102 is a normally on transistor, in other words, in the case where the threshold voltage Vthn is negative, electric charge can be accumulated in the capacitor 105 until the potential V2 of the source of the transistor 102 is higher than the potential V1 of the gate electrode of the transistor 102. Accordingly, in the light-emitting device according to one embodiment of the present invention, even when the transistor 102 is a normally on transistor, the threshold voltage can be obtained in the period T2, and in the period T4, the gate voltage Vgs of the transistor 102 can be set to have a value obtained by adding the threshold voltage Vthn.

Thus, in the light-emitting device according to one embodiment of the present invention, for example, in the case where amorphous silicon or an oxide semiconductor is used for a semiconductor film of the transistor 102, even when the transistor 102 is a normally on transistor, display unevenness can be reduced and a high-quality image can be displayed.

Further, in the case where the potential V2 at the termination of the period T2 is lower than V1−Vthn, a variation in the mobility of the transistors 102 can be prevented from influencing the luminance of the light-emitting elements 104. Hereinafter, this will be more specifically described.

A drain current $I_d$ which flows through the light-emitting element 104 is represented by $I_d=k\mu(Vgs-Vthn)^2/2$, where μ is the mobility of the transistor 102, and k is a constant determined in accordance with the channel length, the channel width, and the gate capacitance of the transistor 102. In the case where correction of the mobility μ is not performed, as the mobility μ increases, the drain current $I_d$ which flows through the light-emitting element 104 also increases, whereas as the mobility μ decreases, the drain current $I_d$ which flows through the light-emitting element 104 also decreases.

For example, in the case where the potential V2 is lower than V1−Vthn, when a voltage between the gate electrode and the source of the transistor 102 is Va, Va has a value obtained by adding the threshold voltage Vthn and the offset voltage Vb. At the termination of the period T4, the gate voltage Vgs of the transistor 102 has a value obtained by adding the potential Vdata of an image signal and the voltage Va, and thus the drain current $I_d$ in the period T5 is represented by $k\mu(Vdata+Va-Vthn)^2/2$. Note that the voltage Va is represented by Vb+Vthn and the drain current $I_d$ is represented by Formula 2 below.

$$I_d=k\mu(Vdata+Vb)^2/2 \quad \text{(Formula 2)}$$

According to Formula 2, it is apparent that even if the threshold voltages Vthn vary, a change in the current values due to a variation in the threshold voltages Vthn is canceled. On the other hand, when the transistor 102 is an n-channel transistor, the offset voltage Vb has a positive value. Accordingly, as the mobility μ decreases, the absolute value of the drain current $I_d$ increases. In contrast, as the mobility μ increases, the absolute value of the drain current $I_d$ decreases. Therefore, Vb serves as a correction term for correcting a variation in the drain current $I_d$ due to the mobility μ in the period T5; a decrease in the drain current $I_d$ can be suppressed even if the mobility μ decreases, whereas an increase in the drain current $I_d$ can be suppressed even if the mobility μ increases.

Note that the amount Q1 of electric charge is preferably small as described above; however, in the case where a variation in the mobility of the transistors 102 is large, an effect of suppressing the variation in the mobility by the amount Q1 of electric charge can be expected. Hereinafter, reasons thereof are explained.

The amount Q1 of electric charge is an amount of electric charge which flows from the drain to the source of the transistor 102 while the potential of the first scan line GLa is at a high level. Accordingly, the amount Q1 of electric charge is increased as the mobility of the transistor 102 increases. It is found from Formula 1 that as the amount Q1 of electric charge is increased, the gate voltage Vgs of the transistor 102 at the time when the light-emitting element 104 emits light is low. In other words, as the mobility of the transistor 102 increases, correction of a variation in the drain current due to the mobility is made by the amount Q1 of electric charge so that the value of current supplied to the light-emitting element 104 is small, whereas, as the mobility of the transistor 102 decreases, correction of a variation in the drain current due to the mobility is made by the amount Q1 of electric charge so that the value of current supplied to the light-emitting element 104 is large. Thus, by the amount Q1 of electric charge, a variation in the mobility can be suppressed as in the case where the potential V2 is lower than V1−Vthn.

This application is based on Japanese Patent Application serial no. 2011-108029 filed with Japan Patent Office on May 13, 2011, the entire contents of which are hereby incorporated by reference.

What is claimed is:

1. A method for driving a light-emitting device comprising the steps of:

supplying a first potential which is supplied to a power supply line to a drain of a transistor through first, second, third, fourth, and fifth periods;

supplying a second potential to a cathode of a light-emitting element through the first, second, third, fourth, and fifth periods, the second potential being lower than the first potential, wherein a source of the transistor and an anode of the light-emitting element are connected to each other, and wherein a voltage between a gate electrode of the transistor and the source of the transistor is held in a capacitor;

turning on a first switch which is provided between a signal line and the gate electrode of the transistor in the first period, thereby supplying a third potential which is supplied to the signal line to the gate electrode of the transistor, wherein the third potential is lower than a potential obtained by adding a threshold voltage of the transistor, a threshold voltage of the light-emitting element, and the second potential;

turning on a second switch which is electrically connected to the capacitor and the source of the transistor in the first period, thereby supplying a fourth potential to the source of the transistor, wherein the fourth potential is lower than a potential obtained by subtracting the threshold voltage of the transistor from the third potential;

turning off the second switch in the second period, thereby stopping supply of the fourth potential to the source of the transistor;

turning off the first switch in the third period, thereby stopping supply of the third potential to the gate electrode of the transistor; and turning on the first switch in the fourth period, thereby supplying a potential of an image signal which is supplied to the signal line to the gate electrode of the transistor.

2. The method for driving a light-emitting device according to claim 1, wherein a capacitance value of the capacitor is smaller than that of the light-emitting element.

3. The method for driving a light-emitting device according to claim 1, wherein the transistor is an n-channel transistor.

4. The method for driving a light-emitting device according to claim 1, wherein the transistor comprises oxide semiconductor in an active layer.

5. The method for driving a light-emitting device according to claim 1, wherein the drain of the transistor and the gate electrode of the transistor are electrically insulated from each other.

6. The method for driving a light-emitting device according to claim 1, further comprising a step of turning off the first switch in the fifth period.

7. A method for driving a light-emitting device comprising the steps of:

supplying a potential Vano to a drain of a transistor through first, second, third, fourth, and fifth periods;

supplying a potential Vcat to a cathode of a light-emitting element through the first, second, third, fourth, and fifth periods, the potential Vcat being lower than the potential Vano, wherein a source of the transistor and an anode of the light-emitting element are connected to each other, and wherein a voltage between a gate electrode of the transistor and the source of the transistor is held in a capacitor;

turning on a first switch which is provided between a signal line and the gate electrode of the transistor in a first period, thereby supplying a potential V1 which is supplied to the signal line to the gate electrode of the transistor, wherein the potential V1 is lower than a potential obtained by adding a threshold voltage of the transistor Vthn, a threshold voltage of the light-emitting element Vthe, and the potential Vcat;

turning on a second switch which is electrically connected to the capacitor and the source of the transistor in a first period, thereby supplying a potential V0 to the source of the transistor, wherein the potential V0 is lower than a potential obtained by subtracting the threshold voltage of the transistor Vthn from the potential V1;

turning off the second switch in the second period, thereby stopping supply of the potential VO to the source of the transistor;

turning off the first switch in the third period, thereby stopping supply of the potential V1 to the gate electrode of the transistor; and turning on the first switch in the fourth period, thereby supplying a potential of an image signal Vdata which is supplied to the signal line to the gate electrode of the transistor.

8. The method for driving a light-emitting device according to claim 7, wherein a capacitance value of the capacitor is smaller than that of the light-emitting element.

9. The method for driving a light-emitting device according to claim 7, wherein each of the transistor, the first switch, and the second switch is an n-channel transistor.

10. The method for driving a light-emitting device according to claim 7, wherein each of the transistor, the first switch, and the second switch comprises oxide semiconductor in an active layer.

11. The method for driving a light-emitting device according to claim 7, wherein the drain of the transistor and the gate electrode of the transistor are electrically insulated from each other.

12. The method for driving a light-emitting device according to claim 7, further comprising a step of turning off the first switch in the fifth period.

13. A method for driving a light-emitting device comprising the steps of:

supplying a first potential which is supplied to a power supply line to a drain of a transistor through first, second, third, fourth, and fifth periods, wherein a gate electrode of the transistor and a source of the transistor are electrically connected to each other through a capacitor;

supplying a second potential to a cathode of a light-emitting element through the first, second, third, fourth, and fifth periods, the second potential being lower than the first potential, wherein the source of the transistor and an anode of the light-emitting element are connected to each other, and;

turning on a first switch which is provided between a signal line and the gate electrode of the transistor in the first period, thereby supplying a third potential which is supplied to the signal line to the gate electrode of the transistor, wherein the third potential is lower than a potential obtained by adding a threshold voltage of the transistor, a threshold voltage of the light-emitting element, and the second potential;

turning on a second switch which is connected to the capacitor and the source of the transistor in the first period, thereby supplying a fourth potential to the source of the transistor, wherein the fourth potential is lower than a potential obtained by subtracting the threshold voltage of the transistor from the third potential;

turning off the second switch in the second period, thereby stopping supply of the fourth potential to the source of the transistor;

turning off the first switch in the third period, thereby stopping supply of the third potential to the gate electrode of the transistor; and turning on the first switch in the fourth period, thereby supplying a potential of an image signal which is supplied to the signal line to the gate electrode of the transistor.

14. The method for driving a light-emitting device according to claim 13, further comprising a step of turning off the first switch in the fifth period.

15. The method for driving a light-emitting device according to claim 13, wherein a capacitance value of the capacitor is smaller than that of the light-emitting element.

16. The method for driving a light-emitting device according to claim 13, wherein each of the transistor, the first switch, and the second switch is an n-channel transistor.

17. The method for driving a light-emitting device according to claim 13, wherein each of the transistor, the first switch, and the second switch comprises oxide semiconductor in an active layer.

18. The method for driving a light-emitting device according to claim 13, wherein the drain of the transistor and the gate electrode of the transistor are electrically insulated from each other.

* * * * *

UNITED STATES PATENT AND TRADEMARK OFFICE

CERTIFICATE OF CORRECTION

PATENT NO. : 9,035,852 B2
APPLICATION NO. : 13/466613
DATED : May 19, 2015
INVENTOR(S) : Koyama et al.

It is certified that error appears in the above-identified patent and that said Letters Patent is hereby corrected as shown below:

In the claims

Claim 7, column 11, line 62, “VO” should read --V0--

Signed and Sealed this
Tenth Day of November, 2015

Michelle K. Lee

Michelle K. Lee
*Director of the United States Patent and Trademark Office*